US005653622A

United States Patent [19]

Drill et al.

[11] Patent Number: 5,653,622

[45] Date of Patent: Aug. 5, 1997

[54] CHEMICAL MECHANICAL POLISHING SYSTEM AND METHOD FOR OPTIMIZATION AND CONTROL OF FILM REMOVAL UNIFORMITY

[75] Inventors: Charles Drill, Boulder Creek; Milind G. Weling, San Jose, both of Calif.

[73] Assignee: VLSI Technology, Inc., San Jose, Calif.

[21] Appl. No.: 506,664

[22] Filed: Jul. 25, 1995

[51] Int. Cl.[6] ..... B24B 49/00; B24B 7/22

[52] U.S. Cl. ..... 451/5; 451/41; 451/21

[58] Field of Search ..... 451/5, 11, 12, 451/21, 288, 14, 443, 444, 41, 24, 287, 10, 8, 56

[56] References Cited

U.S. PATENT DOCUMENTS

| | | | |
|---|---|---|---|
| 3,691,697 | 9/1972 | Bender | 451/24 |
| 3,848,365 | 11/1974 | Bovensiepen et al. | 451/24 |
| 4,712,470 | 12/1987 | Schmitz | 451/21 |

FOREIGN PATENT DOCUMENTS

| | | | |
|---|---|---|---|
| 2152766 | 6/1990 | Japan | 451/287 |
| 0650794 | 3/1979 | U.S.S.R. | 451/10 |
| WO91/12113 | 8/1991 | WIPO | 451/11 |

*Primary Examiner*—Robert A. Rose

*Attorney, Agent, or Firm*—Flehr Hohbach Test Albritton & Herbert LLP

[57] ABSTRACT

A chemical mechanical polishing system for processing semiconductor wafers has a polishing arm and carrier assembly that press the topside surface of a semiconductor wafer against a motor driven, rotating polishing pad. Improved uniformity of material removal, as well as improved stability of material removal rate, is achieved through the use of a controller that applies a variable wafer backside pressure to the wafers being polished. More specifically, a control subsystem maintains a wafer count, corresponding to how many wafers have been polished by the polishing pad. The control subsystem regulates the backside pressure applied to each wafer in accordance with a predetermined function such that the backside pressure increases monotonically as the wafer count increases. In the preferred embodiment, the control system regulates the backside pressure in accordance with a linear function of the form: Backside Pressure=A+(B×Wafer Count). Whenever a new polishing pad is mounted, the wafer count value is reset to a predefined minimum wafer count value and the backside pressure for the next wafer to be polished is reset to a preset minimum backside pressure value.

8 Claims, 2 Drawing Sheets

CHEMICAL MECHANICAL POLISHING SYSTEM AND METHOD FOR OPTIMIZATION AND CONTROL OF FILM REMOVAL UNIFORMITY

The present invention relates generally to systems for chemical mechanical polishing of semiconductor wafers, and particularly to a system for improving the uniformity of material removal over the surface of each wafer as a large number of wafers are sequentially processed using the same polishing pad in a chemical mechanical polishing system.

BACKGROUND OF THE INVENTION

Chemical mechanical polishing (CMP) is being increasingly used in the manufacturing of integrated circuits for dielectric planarization and metal polishing processing steps. The single most difficult problem with the CMP process in the commercial manufacturing environment are maintaining a stable material removal rate and maintaining uniformity of material removal on each wafer when processing hundreds of wafers with a single polishing pad.

The CMP process has a tendency to polish faster (i.e., remove material faster) towards the edges of a wafer. Polishing pad conditioning with abrasive surfaces and use of a fixed wafer backside pressure (sometimes called backpressure) have been suggested and used in the past for long term stability of the CMP process.

Referring to FIG. 1, in a conventional CMP system 100, a wafer 102 whose top surface 104 is to be polished is held in an inverted position by a carrier assembly 106 and polishing arm 108. The wafer 102 is held in position against a rotating polishing pad 110 which removes material from the top surface 104 of the wafer 102 from mechanical abrasion from the polishing pad 110 and particles in the slurry and from chemical action from the slurry on the polishing pad 110. Rotation of the polishing pad during the polishing process is caused by a motor 112, while rotation of the wafer is caused by another motor 114. In addition there is a periodic translation motion by the polishing arm 108 so as to use different portions of the polishing pad over time.

The carrier assembly 106 is a pneumatic carrier that is connected to a vacuum pump and air pressure pump assembly 120 via tubing (not shown) in the polishing arm 108. The pneumatic carrier includes a perforated steel plate 122 and a capture ring 124, which together hold a perforated carrier pad 126 and the wafer 102. When a wafer is first moved by an automated wafer transportation system 130 from a wafer transport tray 132 to the carrier assembly 106, a vacuum pump is coupled to the carrier assembly 106 so as to hold the wafer in place while the polishing arm moves the wafer into position adjacent the polishing pad 110. After the wafer is in position and polishing begins, backside pressure can be applied to the wafer by (A) downward movement of the polishing arm 108 and (B) application of positive air pressure through the perforated metal carrier plate 122 and carrier pad 126.

Slurry is dispensed onto the polishing pad 110 through a slurry inlet 128. A pad conditioning system 140 conditions the polishing pad with abrasive surfaces. Conditioning the pad makes it rough, which allows effective application of downward force and also causes the pad to act as a conduit for slurry flow to the wafer surface.

It is a goal of the present to improve, in a chemical mechanical polishing system for processing semiconductor wafers, the stability of the material removal rate and to improve the uniformity of material removal on each wafer when processing hundreds of wafers with a single polishing pad and a single carrier pad.

SUMMARY OF THE INVENTION

In summary, the present invention is an improved chemical mechanical polishing system for processing semiconductor wafers in which a polishing arm and carrier assembly press the top surface of a semiconductor wafer against a rotating polishing pad. Improved uniformity of material removal, as well as improved stability of material removal rate, is achieved through the use of a controller that adjusts the wafer backside pressure applied to each wafer as it is being polished.

More specifically, in the chemical mechanical polishing system of the present invention a control subsystem maintains a wafer count, corresponding to how many wafers have been polished by the polishing pad. The control subsystem regulates the backside pressure applied to each wafer in accordance with a predetermined function such that the backside pressure increases monotonically as the wafer count increases. In the preferred embodiment, the control system regulates the backside pressure in accordance with a linear function of the form $$\text{Backside Pressure}=A+(B\times\text{Wafer Count}).$$

When a new polishing pad is mounted, the wafer count value is reset to a predefined minimum wafer count value, and the backside pressure for the next wafer to be polished is reset to a preset minimum backside pressure value.

BRIEF DESCRIPTION OF THE DRAWINGS

Additional objects and features of the invention will be more readily apparent from the following detailed description and appended claims when taken in conjunction with the drawings, in which:

Figure 1:
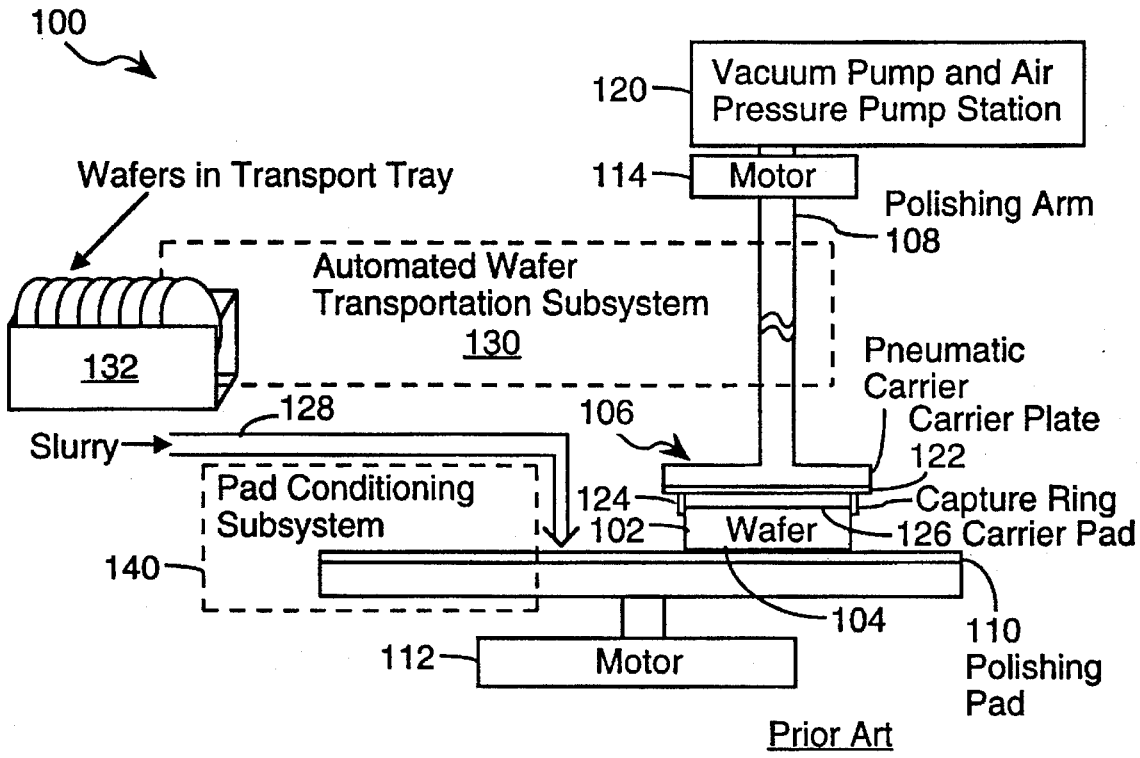
FIG. 1 is a schematic representation of a prior art chemical mechanical polishing system for processing semiconductor wafers.

Like reference numerals refer to corresponding parts throughout the several views of the drawings. Furthermore, it is noted that various objects in the drawings are not drawn to scale. Rather, the drawings schematically represent the functional and structural relationships between components of the preferred embodiment.

DESCRIPTION OF THE PREFERRED EMBODIMENT

Figure 2:
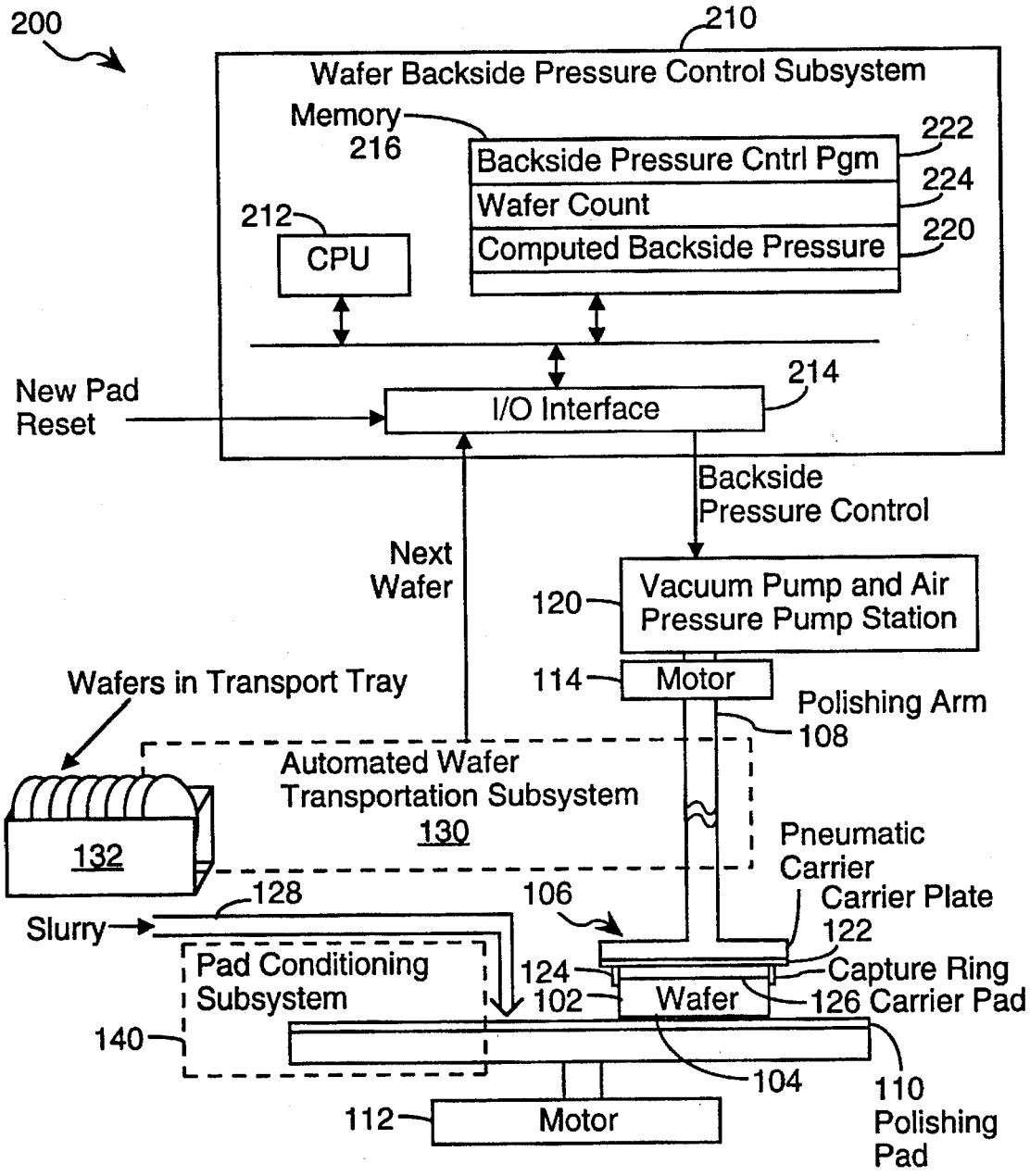
FIG. 2 is a schematic representation of an improved chemical mechanical polishing system for processing semiconductor wafers.

Referring to FIG. 2, there is shown CMP system 200 in accordance with the present invention. Like a conventional CMP system, the CMP system 200 of the present invention has a carrier assembly 106 and polishing arm 108 for holding a wafer 102 in an inverted position. The wafer 102 is held in position against a rotating polishing pad 110 which removes material from the top surface 104 of the wafer 102 both from mechanical abrasion and through the use of etching and other material removal chemicals on the polishing pad 110. Rotation of the polishing pad during the polishing process is caused by a motor 112, while rotation of the wafer is caused by another motor 114.

All aspects of the conventional CMP system 100 described above with reference to FIG. 1 also apply to the CMP system 200 of the present invention.

The CMP system 200 of the present invention differs from the prior art system in that it includes a programmed digital computer subsystem 210 that is herein called the backside pressure control subsystem. The wafer backside pressure control subsystem 210 is coupled to the automated wafer transportation subsystem 130 such that the backside pressure control subsystem 210 receives a "next wafer" signal each time that another wafer is transported from a transport tray 132 to the carrier assembly 106. The wafer backside pressure control subsystem 210 also receives a "new pad reset" signal each time that the polishing pad 110 is replaced with a new pad. In the preferred embodiment the "new pad reset" signal is generated "manually," by pressing a key on the console of the control subsystem 210. In alternate embodiments, a system that automatically detects the replacement of the polishing pad could be used to generate the "new pad reset" signal.

The wafer backside pressure control subsystem 210 includes a CPU 212, an input/output interface 214, and a memory 216. The input/output interface 214 receives the "new pad reset" signal and the "next wafer" signal, and outputs a "backside pressure control" signal to the vacuum pump and air pressure pump station 120. The backside pressure control signal corresponds to a computed backside pressure value 220 generated by the backside pressure control subsystem 210 using a backside pressure control program 222 in accordance with a wafer count value 224 stored in the local memory 216. The wafer count value 222 reflects the number of wafers processed using the same polishing pad 110.

Figure 3:
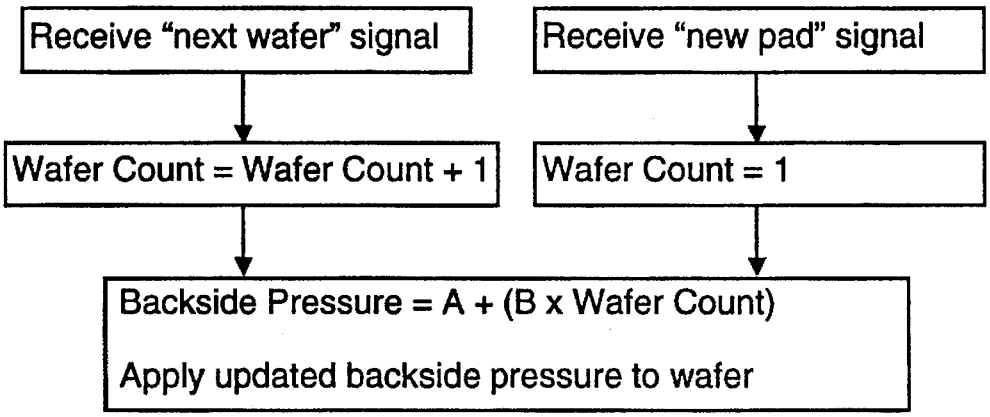
FIG. 3 is a flow chart representing the methodology of a preferred embodiment of the present invention.

Referring to FIGS. 2 and 3, the present invention uses variable wafer backside pressure to optimize and control removal rate uniformity. In particular, experiments by the inventors have shown that uniformity follows a linear degradation, with wafer count. That is, as the number of wafers polished with a single polishing pad increases, the material removal rate degrades at a rate that is linearly proportional to the wafer count.

In addition, it has been observed by the inventors that the uniformity of material removal rate also degrades linearly with increasing backside pressure. However, the inventors have determined that the trends in these two uniformity degradation are opposites. An increase in the wafer count is accompanied by an increase in the material removal rate towards the edge of the wafers being polished, whereas an increase in backside pressure increases the material removal rate towards the wafers' centers.

In accordance with the present invention, the material removal rate uniformity degradation experienced as more wafers are polished with the same polishing pad is compensated by using controlled and increasing amounts of backside pressures, which results in substantially improved uniformity of material removal rates across the wafers being polished. The dependence of uniformity on wafer count and backside pressure can be modelled and approximated to a two-variable mathematical equation. In particular, wafer backside pressure can be modulated as a function of wafer count by utilizing the on-board wafer counter on the polisher (as represented by the wafer count value 224 in memory 216 in FIG. 2) and designating backside pressure for as a wafer counter set variable. In one polishing process used by the inventors, backside pressure is optimized for best achievable uniformity when the backside pressure is adjusted for wafer count in accordance with the following formula:

$$\text{Backside Pressure (lbs)}=0.18+(0.066\times\text{Wafer Count})$$

As shown in FIG. 3, the backside pressure is recomputed each time that a "next wafer" or "new pad" signal is received, and then the recomputed backside pressure is applied to the next wafer to be polished. The polishing process for which the above backside pressure formula is used is characterized as follows. The pad used is a "hard" pad, IC1000 from Rodel, on top of a "soft" pad, Suba IV from Rodel. The slurry used is ILD1300 from Rodel, which is an ammonium hydroxide slurry. The carrier film between the wafer carrier assembly and the wafer is DF200 from Rodel, which is a mylar backed film. The backside pressure formula shown above is applicable for wafer count values ranging from 1 to approximately 500. The number of wafers polished with each polishing pad is typically 300 to 500 wafers.

The formula for adjusting backside pressure with wafer count will vary from one CMP wafer polishing system to the next. Each CMP wafer polishing system needs to be modelled for each particular type of polishing pad and pad conditioning regimen used so as to generate a formula representing the dependence of polishing uniformity on wafer count and backside pressure for that particular CMP wafer polishing configuration.

In the preferred embodiment, the formula for adjusting backside pressure is a linear function of the form:

$$\text{Backside Pressure}=A+(B\times\text{Wafer Count})$$

In alternate embodiments of the present invention, other formulas, such as a quadratic formula, might be used, for instance if the model of a particular polishing system indicated a non-linear relationship between material rate uniformity, backside pressure and wafer count. In general, however, the backside pressure applied to the wafer will be regulated in accordance with a predetermined function such that the backside pressure increases monotonically as the wafer count increases. Furthermore, in general, whenever a new polishing pad is mounted, the wafer count value is reset to a predefined minimum wafer count value (typically zero or one) and the backside pressure for the next wafer to be polished is reset to a preset minimum backside pressure value.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A chemical mechanical polishing (CMP) system, comprising:

a motor driven polishing pad;

a wafer carrier for holding a semiconductor wafer against the polishing pad such that a topside surface of the wafer is polished by said polishing pad;

a pressure subsystem, coupled to the wafer carrier, for applying a controllable amount of pressure to a backside of the wafer held by the wafer carrier; and a control subsystem coupled to said pressure subsystem for maintaining a wafer count, corresponding to how many wafers have been polished by said polishing pad, and for regulating said backside pressure applied to said wafer in accordance with a predetermined function such that said backside pressure increases monotonically as said wafer count increases.

2. The CMP system of claim 1, wherein said control system regulates said backside pressure in accordance with a linear function of the form:

$$\text{Backside pressure}=A+(B\times\text{Wafer Count}).$$

3. The CMP system of claim 2, wherein whenever a new polishing pad is mounted, said control system resets said wafer count to a predefined minimum wafer count value and resets the backside pressure for the next wafer to be polished to a preset minimum backside pressure value.

4. The CMP system of claim 1, wherein whenever a new polishing pad is mounted, said control system, resets said wafer count to a predefined minimum wafer count value and resets the backside pressure for the next wafer to be polished to a preset minimum backside pressure value.

5. A method of chemical mechanical polishing semiconductor wafers, comprising the steps of:

holding a semiconductor wafer against a motor driven polishing pad such that a topside surface of the wafer is polished by said polishing pad;

applying a controllable amount of pressure to a backside of the wafer;

maintaining a wafer count, corresponding to how many wafers have been polished by said polishing pad; and regulating said backside pressure applied to said wafer in accordance with a predetermined function such that said backside pressure increases monotonically as said wafer count increases.

6. The method of claim 5, wherein said regulating step regulates said backside pressure in accordance with a linear function of the form:

$$\text{Backside pressure}=A+(B\times\text{Wafer Count}).$$

7. The method of claim 6, wherein whenever a new polishing pad is mounted, said wafer count is reset to a predefined minimum wafer count value and resets the backside pressure for the next wafer to be polished to a preset minimum backside pressure value.

8. The method of claim 5, wherein whenever a new polishing pad is mounted, said wafer count is reset to a predefined minimum wafer count value and resets the backside pressure for the next wafer to be polished to a preset minimum backside pressure value.

* * * * *